US007537471B2

(12) United States Patent
Teicher

(10) Patent No.: US 7,537,471 B2
(45) Date of Patent: May 26, 2009

(54) SYSTEMS OF RELIABLY INTERCONNECTABLE REVERSIBLE USB CONNECTORS

(75) Inventor: Mordechai Teicher, Hod Hashsaron (IL)

(73) Assignee: SanDisk IL, Ltd., Kfar Saba (IL)

( * ) Notice: Subject to any disclaimer, the term of this patent is extended or adjusted under 35 U.S.C. 154(b) by 124 days.

(21) Appl. No.: 11/850,688

(22) Filed: Sep. 6, 2007

(65) Prior Publication Data

US 2008/0119076 A1 May 22, 2008

Related U.S. Application Data

(60) Provisional application No. 60/866,859, filed on Nov. 22, 2006.

(51) Int. Cl.
*H01R 29/00* (2006.01)

(52) U.S. Cl. ..... 439/172

(58) Field of Classification Search ..... 439/172, 439/173, 68, 660, 52, 53, 217, 218, 954
See application file for complete search history.

(56) References Cited

U.S. PATENT DOCUMENTS 5,496,186 A * 3/1996 Dobbelaere et al. ..... 439/79
5,925,170 A * 7/1999 Nojima ..... 96/71
6,981,887 B1 * 1/2006 Mese et al. ..... 439/244
7,094,086 B2 8/2006 Teicher
7,363,947 B2 * 4/2008 Teicher ..... 139/173
7,381,076 B2 * 6/2008 Bychkov et al. ..... 439/344
2004/0103228 A1 * 5/2004 Kao ..... 710/72
2004/0115990 A1 * 6/2004 Kodama ..... 439/607
2008/0254680 A1 * 10/2008 Chiu et al. ..... 439/607
2008/0299833 A1 * 12/2008 Abe ..... 439/660
2009/0011621 A1 * 1/2009 Trenne ..... 439/68

* cited by examiner

*Primary Examiner*—Alexander Gilman
(74) *Attorney, Agent, or Firm*—Mark M. Friedman

(57) ABSTRACT

Systems of reversible USB type-A connectors which can be functionally mated with standard USB type-A connectors in each of two coupling orientations can also be reversibly mated with each other. Each plug and each receptacle includes at least one displaceable element which assumes: (a) a neutral configuration prior to coupling with the standard USB receptacle, (b) a first displaced configuration when coupled with the standard USB receptacle in a first coupling orientation, and (c) a second displaced configuration when coupled with the standard USB receptacle in a second coupling orientation. The reversible plug and the reversible receptacle are adapted for functionally mating with each other in each of two relative coupling orientations such that the displaceable element of a pre-selected one of the connectors assumes the corresponding first displaced configuration independent of the relative coupling orientation between the connectors.

25 Claims, 13 Drawing Sheets

SYSTEMS OF RELIABLY INTERCONNECTABLE REVERSIBLE USB CONNECTORS

This application claims the benefit of provisional patent application No. 60/866,859 filed Nov. 22, 2006.

FIELD AND BACKGROUND OF THE INVENTION

The present invention relates to USB connectors and, in particular, it concerns reversible USB plugs and receptacles for mating both with standard connectors and with each other.

By way of introduction, a standard USB plug can be inserted into a standard USB receptacle in only one of two possible orientations; if the USB plug is in an inverted orientation relative to the USB receptacle, the plug and receptacle cannot be coupled. As a result, the user will often attempt to insert a plug into a receptacle in an incorrect orientation. In a situation in which a USB plug is frequently inserted and removed from a USB receptacle, such errors may become a significant inconvenience for the user. Furthermore, in the case of a device with an integrated USB plug, the orientation of the device when docked with a host appliance is dictated by the orientation of the USB receptacle on the host appliance. In the case of an asymmetrically shaped device, the device may block access to other ports of the host or otherwise obstruct other peripheral devices from being connected to the host appliance. If it were possible to reverse the orientation, the problem would typically be avoided.

U.S. Pat. No. 7,094,086 to the present inventor (referred to below as "the '086 patent"), which is hereby incorporated by reference in its entirety, discloses various reversible USB connectors, both in the form of plugs for mating with a standard USB type-A receptacle and receptacles for mating with a standard USB type-A plug. In each case, the reversible connector allows functional mating with a standard connector in either of two coupling orientations, thereby relieving the aforementioned orientation limitations on USB connections.

Although the '086 patent discloses both reversible plugs and reversible receptacles for mating with the complementary standard USB connectors, the patent does not address coupling of reversible plugs with reversible receptacles. In certain cases, attempts to couple two such reversible connectors may result in unpredictable results, possibly leading to jamming of the moving parts within the reversible connectors, or in engagement in a manner which would not achieve electrical connection between the connectors.

There is therefore a need for reversible USB connectors which can functionally mate both with standard USB connectors and with other reversible connectors in a predictable and reliable manner.

SUMMARY OF THE INVENTION

The present invention provides reversible USB connectors and systems including such reversible USB plugs and receptacles for mating both with standard connectors and with each other.

According to the teachings of the present invention there is provided, a system comprising: (a) a reversible plug for functionally mating with a standard USB type-A receptacle in each of two coupling orientations, the reversible plug including at least one displaceable element, the at least one displaceable element assuming: (i) a neutral configuration prior to coupling with the standard USB receptacle, (ii) a first displaced configuration when coupled with the standard USB receptacle in a first coupling orientation, and (iii) a second displaced configuration when coupled with the standard USB receptacle in a second coupling orientation; and (b) a reversible receptacle for functionally mating with a standard USB type-A plug in each of two coupling orientations, the reversible receptacle including at least one displaceable element, the at least one displaceable element assuming: (i) a neutral configuration prior to coupling with the standard USB plug, (ii) a first displaced configuration when coupled with the standard USB plug in a first coupling orientation, and (iii) a second displaced configuration when coupled with the standard USB plug in a second coupling orientation, wherein the reversible plug and the reversible receptacle are further adapted for functionally mating with each other in each of two relative coupling orientations such that the at least one displaceable element of a pre-selected one of the reversible plug and the reversible receptacle assumes the corresponding first displaced configuration independent of the relative coupling orientation between the reversible plug and the reversible receptacle.

According to a further feature of the present invention, each of the reversible plug and the reversible receptacle includes a shielding sleeve, each of the shielding sleeves defining a corresponding direction of mating, and wherein the at least one displaceable element of each of the reversible plug and the reversible receptacle includes a tongue element displaceable in a direction perpendicular to the corresponding direction of mating.

According to a further feature of the present invention, when the pre-selected one of the reversible plug and the reversible receptacle assumes the corresponding neutral configuration, the tongue element provides a leading edge located with a marginal offset from a central position relative to the shielding sleeve.

According to a further feature of the present invention, the tongue element of the pre-selected one of the reversible plug and the reversible receptacle has a leading edge deployed, when in the corresponding neutral configuration, in a substantially central position within the shielding sleeve, and wherein the tongue element further includes a recessed region including an inclined deflector surface, and wherein the tongue of the other of the reversible plug and the reversible receptacle has a leading projection configured to impinge on the deflector surface during mating of the reversible plug and the reversible receptacle.

According to a further feature of the present invention, the at least one displaceable element of each of the reversible plug and the reversible receptacle includes a pair of retractable slides assuming an initial position in the neutral configuration, a first of the slides being displaceable to a retracted position to form the first displaced configuration, and a second of the slides being displaceable to a retracted position to form the second displaced configuration.

According to a further feature of the present invention, the first retractable slide of the pre-selected one of the reversible plug and the reversible receptacle is formed with at least part of a detent arrangement deployed to provide a threshold of resistance to oppose displacement of the first retractable slide from the neutral position to the retracted position.

According to a further feature of the present invention, the pre-selected one of the reversible plug and the reversible receptacle is the reversible plug, and wherein the reversible plug includes a shielding sleeve, the detent arrangement including a lateral projection and corresponding recess formed in the shielding sleeve and the first retractable slide.

According to a further feature of the present invention, the lateral projection is arranged on a spring element integrally formed with the first slide, the wherein the spring element flexes on exertion of force greater than the threshold of resistance to allow the lateral projection to clear the corresponding recess.

According to a further feature of the present invention, both of the first and second slides of the reversible receptacle are formed with a projecting feature such that, in each of the relative coupling orientations, one of the projecting features engages the spring element so as to inhibit flexing of the spring element.

According to a further feature of the present invention, the first and second retractable slides of the pre-selected one of the reversible plug and the reversible receptacle are biased, respectively, from the corresponding retracted positions to the initial positions by corresponding first and second springs, and wherein the first and second retractable slides of the other of the reversible plug and the reversible receptacle are biased, respectively, from the corresponding retracted positions to the initial positions by corresponding third and fourth springs, each of the first, second, third and fourth springs having a corresponding spring constant K1, K2, K3 and K4 such that: (a) K1 is greater than both K3 and K4; and (b) K2 is smaller than both K3 and K4.

According to a further feature of the present invention, K3 is substantially equal to K4.

There is also provided according to the teachings of the present invention, a system comprising a reversible connector for functionally mating with a standard USB type-A connector in each of two coupling orientations, the reversible connector including: (a) a shielding sleeve defining a direction of mating, and (b) a tongue element deployed within the shielding sleeve and displaceable in a direction perpendicular to the corresponding direction of mating between: (i) a neutral position prior to coupling with the standard USB connector, (ii) a first displaced position when coupled with the standard USB connector in a first coupling orientation, and (iii) a second displaced position when coupled with the standard USB connector in a second coupling orientation, wherein the reversible connector is configured such that, when the tongue element assumes the neutral position, the tongue element provides a leading edge located with a marginal offset from a central position relative to the shielding sleeve, the marginal offset being such that, when the reversible connector mates with the standard USB connector in either coupling orientation, the tongue element is displaced by engagement with the standard USB connector towards a corresponding one of the first and second displaced positions and, when the reversible connector mates with a non-standard connector having a centrally positioned leading edge, the tongue element is always displaced towards the second displaced position.

According to a further feature of the present invention, a major part of the tongue element is deployed substantially centrally within the shielding sleeve and the leading edge is provided by an asymmetric edge portion.

According to a further feature of the present invention, the reversible connector is a reversible receptacle for functionally mating with a standard USB type-A plug.

According to a further feature of the present invention, the reversible connector is referred to as the first reversible connector, the system further comprising a second reversible connector for functionally mating in each of two coupling orientations with each of the first reversible connector and a standard USB type-A connector complementary to that with which the first reversible connector functionally mates, the second reversible connector including: (a) a shielding sleeve defining a direction of mating, and (b) a tongue element deployed within the shielding sleeve and displaceable in a direction perpendicular to the corresponding direction of mating between: (i) a neutral position prior to coupling with the standard USB connector, (ii) a first displaced position when coupled with the standard USB connector in a first coupling orientation, and (iii) a second displaced position when coupled with the standard USB connector in a second coupling orientation, wherein the tongue element of the second reversible connector, when in the neutral position, presents a leading edge substantially centrally positioned relative to the shielding sleeve.

There is also provided according to the teachings of the present invention, a system comprising a reversible connector for functionally mating with a standard USB type-A connector in each of two coupling orientations, the reversible connector including: (a) a shielding sleeve defining a direction of mating, and (b) a tongue element deployed within the shielding sleeve and displaceable in a direction perpendicular to the corresponding direction of mating between: (i) a neutral position prior to coupling with the standard USB connector, (ii) a first displaced position when coupled with the standard USB connector in a first coupling orientation, and (iii) a second displaced position when coupled with the standard USB connector in a second coupling orientation, wherein the tongue element has a leading edge deployed, when in the corresponding neutral configuration, in a substantially central position within the shielding sleeve, and wherein the tongue element further includes a recessed region including an inclined deflector surface, such that, when the reversible connector mates with the standard USB connector in either coupling orientation, the tongue element is displaced by engagement of the leading edge with the standard USB connector towards a corresponding one of the first and second displaced positions and, when the reversible connector mates with a non-standard connector having a leading projection deployed to impinge on the deflector surface, the tongue element is always displaced towards the second displaced position.

According to a further feature of the present invention, the reversible connector is referred to as the first reversible connector, the system further comprising a second reversible connector for functionally mating in each of two coupling orientations with each of the first reversible connector and a standard USB type-A connector complementary to that with which the first reversible connector functionally mates, the second reversible connector including: (a) a shielding sleeve defining a direction of mating, and (b) a tongue element deployed within the shielding sleeve and displaceable in a direction perpendicular to the corresponding direction of mating between: (i) a neutral position prior to coupling with the standard USB connector, (ii) a first displaced position when coupled with the standard USB connector in a first coupling orientation, and (iii) a second displaced position when coupled with the standard USB connector in a second coupling orientation, wherein the tongue of the second reversible connector has a leading projection configured to impinge on the deflector surface during mating of the first and second reversible connectors.

There is also provided according to the teachings of the present invention, a system comprising a reversible connector for functionally mating with a standard USB type-A connector in each of two coupling orientations, the reversible connector including: (a) a shielding sleeve defining a direction of mating, and (b) a pair of retractable slides each assuming an initial position and selectively retractable parallel to the direction of mating to a retracted position, the pair of slides assuming: (i) a neutral configuration, prior to coupling with the standard USB connector, in which both of the slides are in the initial position, (ii) a first displaced configuration, when coupled with the standard USB connector in a first coupling orientation, in which a first of the slides is in the retracted position, and (iii) a second displaced configuration, when coupled with the standard USB connector in a second coupling orientation, in which a second of the slides is in the retracted position, wherein the first retractable slide is formed with at least part of a detent arrangement deployed to provide a threshold of resistance to oppose displacement of the first retractable slide from the neutral position to the retracted position.

According to a further feature of the present invention, the reversible connector is a reversible plug, and wherein the detent arrangement includes a lateral projection and corresponding recess formed in the shielding sleeve and the first retractable slide.

According to a further feature of the present invention, the lateral projection is arranged on a spring element integrally formed with the first slide, the wherein the spring element flexes on exertion of force greater than the threshold of resistance to allow the lateral projection to clear the corresponding recess.

According to a further feature of the present invention, there is also provided a reversible receptacle for functionally mating in each of two coupling orientations with each of the reversible plug and a standard USB type-A plug, the reversible receptacle including: (a) a shielding sleeve defining a direction of mating; and (b) a pair of retractable slides each assuming an initial position and selectively retractable parallel to the direction of mating to a retracted position, the pair of retractable slides assuming: (i) a neutral configuration, prior to coupling with the standard USB plug, in which both of the slides are in the initial position, (ii) a first displaced configuration, when coupled with the standard USB plug in a first coupling orientation, in which a first of the slides is in the retracted position, and (iii) a second displaced configuration, when coupled with the standard USB plug in a second coupling orientation, in which a second of the slides is in the retracted position, wherein both of the first and second slides of the reversible receptacle are formed with a projecting feature such that, in each of the relative coupling orientations, one of the projecting features engages the spring element so as to inhibit flexing of the spring element.

According to a further feature of the present invention, the reversible connector is referred to as the first reversible connector, the system further comprising a second reversible connector for functionally mating in each of two coupling orientations with each of the first reversible connector and a standard USB type-A connector complementary to that with which the first reversible connector functionally mates, the second reversible connector including: (a) a shielding sleeve defining a direction of mating, and (b) a pair of retractable slides each assuming an initial position and selectively retractable parallel to the direction of mating to a retracted position, the pair of slides assuming: (i) a neutral configuration, prior to coupling with the standard USB connector, in which both of the slides are in the initial position, (ii) a first displaced configuration, when coupled with the standard USB connector in a first coupling orientation, in which a first of the slides is in the retracted position, and (iii) a second displaced configuration, when coupled with the standard USB connector in a second coupling orientation, in which a second of the slides is in the retracted position.

There is also provided according to the teachings of the present invention, a system comprising a reversible connector for functionally mating with a standard USB type-A connector in each of two coupling orientations, the reversible connector including: (a) a shielding sleeve defining a direction of mating, and (b) a pair of retractable slides each assuming an initial position and selectively retractable parallel to the direction of mating to a retracted position, the pair of slides assuming: (i) a neutral configuration, prior to coupling with the standard USB connector, in which both of the slides are in the initial position, (ii) a first displaced configuration, when coupled with the standard USB connector in a first coupling orientation, in which a first of the slides is in the retracted position, and (iii) a second displaced configuration, when coupled with the standard USB connector in a second coupling orientation, in which a second of the slides is in the retracted position, wherein the first slide is biased from the retracted position to the initial position by a first spring having a spring constant K1, and the second slide is biased from the retracted position to the initial position by a second spring having a spring constant K2, K1 being significantly greater than K2.

According to a further feature of the present invention, the reversible connector is referred to as the first reversible connector, the system further comprising a second reversible connector for functionally mating in each of two coupling orientations with each of the first reversible connector and a standard USB type-A connector complementary to that with which the first reversible connector functionally mates, the second reversible connector including: (a) a shielding sleeve defining a direction of mating, and (b) a pair of retractable slides each assuming an initial position and selectively retractable parallel to the direction of mating to a retracted position, the pair of slides assuming: (i) a neutral configuration, prior to coupling with the standard USB connector, in which both of the slides are in the initial position, (ii) a first displaced configuration, when coupled with the standard USB connector in a first coupling orientation, in which a first of the slides is in the retracted position, and (iii) a second displaced configuration, when coupled with the standard USB connector in a second coupling orientation, in which a second of the slides is in the retracted position, wherein the first slide is biased from the retracted position to the initial position by a first spring having a spring constant K3, and the second slide is biased from the retracted position to the initial position by a second spring having a spring constant K4, wherein K3 and K4 have values smaller than K1 and greater than K2.

According to a further feature of the present invention, K3 is substantially equal to K4.

BRIEF DESCRIPTION OF THE DRAWINGS

The invention is herein described, by way of example only, with reference to the accompanying drawings, wherein.

DESCRIPTION OF THE PREFERRED EMBODIMENTS

Figure 1:
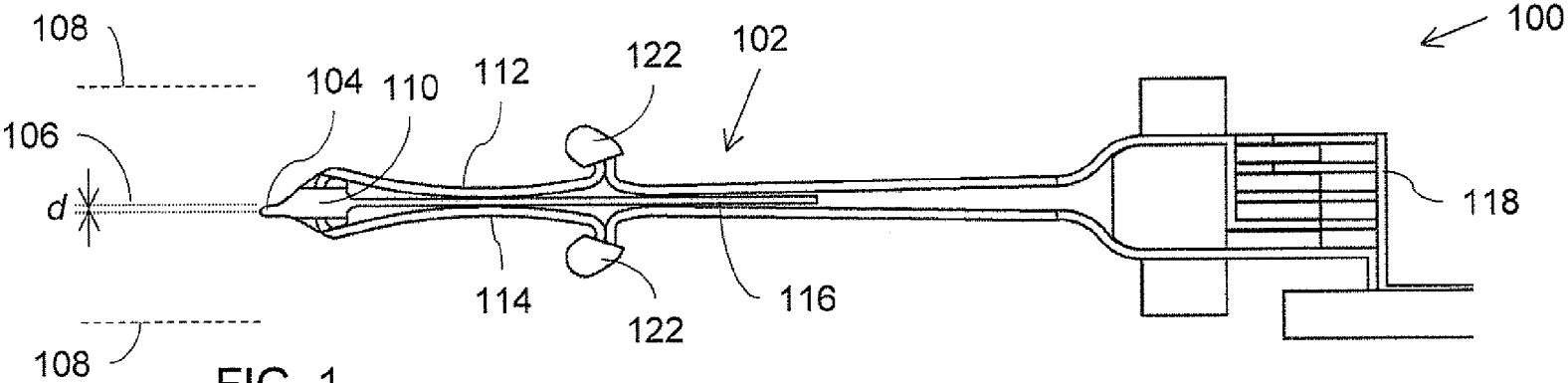
FIG. 1 is a side view of a first embodiment of a reversible USB connector, constructed and operative according to the teachings of the present invention, for mating both with standard USB type-A connectors and with other reversible USB connectors, the reversible connector being shown with a shielding sleeve omitted for clarity of presentation.
Figure 2:
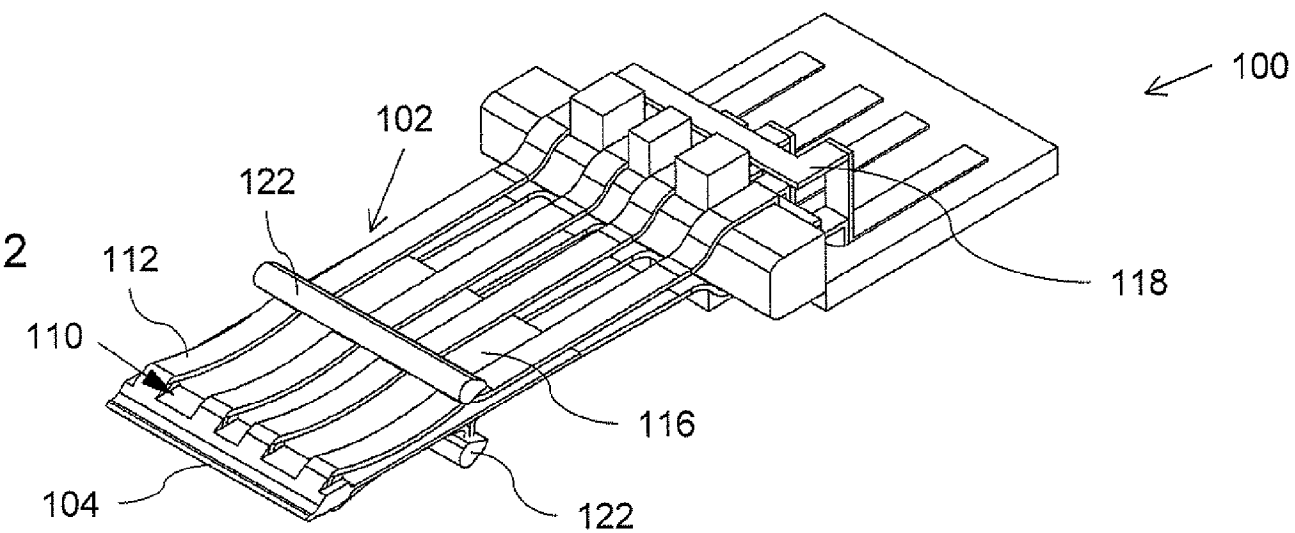
FIG. 2 is an isometric view of the structure of FIG. 1.
Figure 3A:
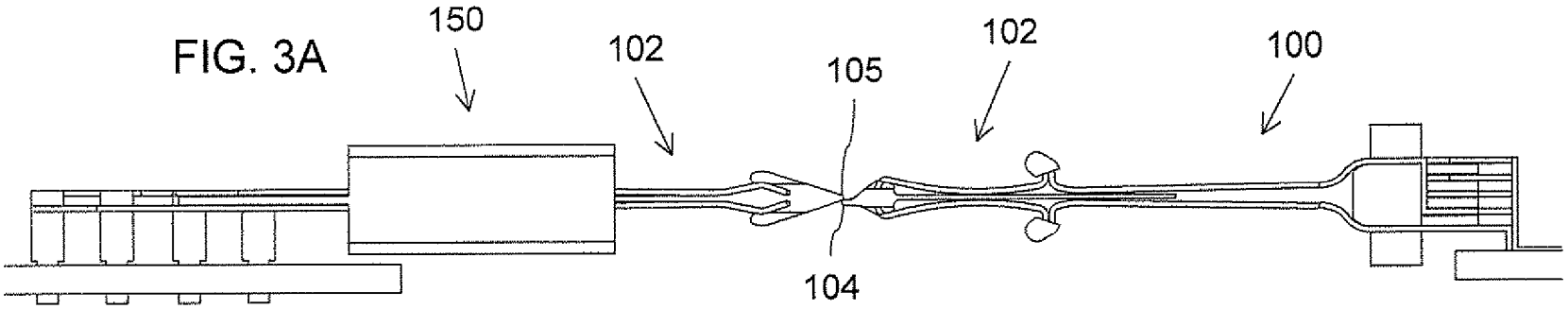
FIGS. 3A and 3B are side views of the structure of FIG. 1 mating with another reversible USB connector, again with the shielding sleeves omitted, the views showing an initial stage of mating and a fully engaged stage, respectively.
Figure 3B:
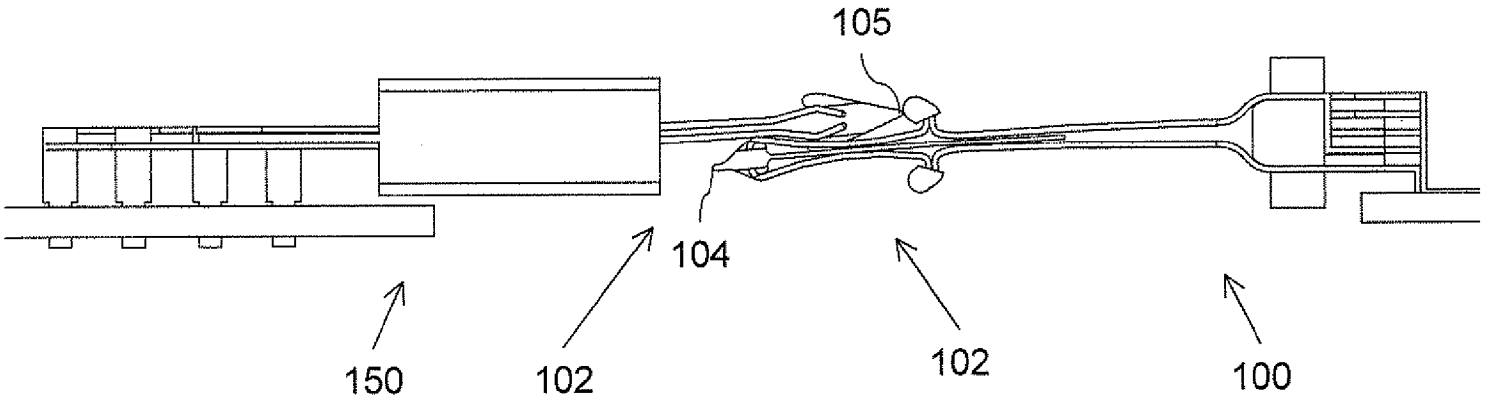
Figure 4:
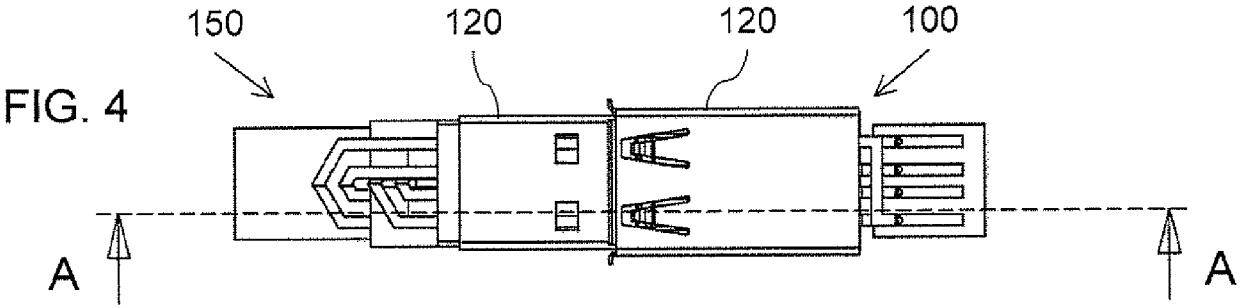
FIG. 4 is a plan view of the mating reversible connectors of FIG. 3A shown with the shielding sleeves.
Figure 5:
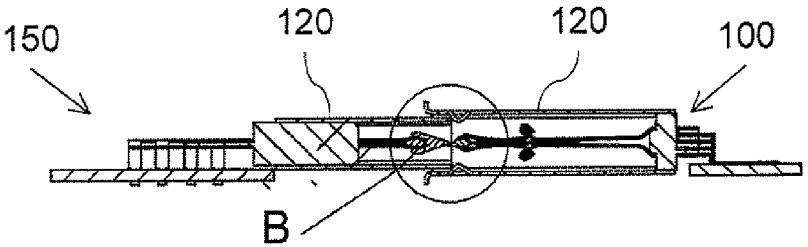
FIG. 5 is a cross-sectional view taken along the line A-A in FIG. 4.

The present invention is a system including a reversible USB plug and a reversible USB receptacle, each of which is configured for functionally mating in a well defined and predictable manner in each of two coupling orientations with a standard USB connector of the corresponding type and with each other. The invention also relates to the features of the individual connectors for such systems.

The principles and operation of systems according to the present invention may be better understood with reference to the drawings and the accompanying description.

By way of introduction, the present invention relates to systems of reversible USB type-A connectors, such as those described in the aforementioned U.S. Pat. No. 7,094,086, which can be functionally mated with standard USB type-A connectors in each of two coupling orientations. The '086 patent describes various embodiments of reversible plugs for mating with standard USB receptacles and various embodiments of reversible receptacles for mating with standard USB plugs. For the purpose of this document, the various reversible connectors described therein are assumed to define the current state of the art. For conciseness of presentation, features of the connectors not directly related to the point of novelty of the present invention will only be described to the extent necessary for an understanding of this invention. Further useful background information regarding other features of the connector described and variants thereof may be found in the '086 patent, and will not be reproduced here.

The present invention will be illustrated hereinbelow with reference to four embodiments, two of which relate closely to a first family of connector embodiments from the '086 patent, and two of which relate closely to a second family of connector embodiments therefrom. It should be noted, however, that the general principles of the present invention are not limited to these embodiments, and are also applicable to a wide range of different reversible USB connector embodiments.

In general terms, a system constructed and operative according to the teachings of the present invention includes a reversible plug for functionally mating with a standard USB type-A receptacle in each of two coupling orientations, and a reversible receptacle for functionally mating with a standard USB type-A plug in each of two coupling orientations.

The reversible plug includes at least one displaceable element which assumes: (a) a neutral configuration prior to coupling with the standard USB receptacle, (b) a first displaced configuration when coupled with the standard USB receptacle in a first coupling orientation, and (c) a second displaced configuration when coupled with the standard USB receptacle in a second coupling orientation. Similarly, the reversible receptacle includes at least one displaceable element which assumes: (a) a neutral configuration prior to coupling with the standard USB plug, (b) a first displaced configuration when coupled with the standard USB plug in a first coupling orientation, and (c) a second displaced configuration when coupled with the standard USB plug in a second coupling orientation.

It is a particular feature of the present invention that the reversible plug and the reversible receptacle are further adapted for functionally mating with each other in each of two relative coupling orientations such that the at least one displaceable element of a pre-selected one of the reversible plug and the reversible receptacle assumes the corresponding first displaced configuration independent of the relative coupling orientation between the reversible plug and the reversible receptacle. In other words, the structure of the reversible plug and reversible receptacle are such that the displacement of the displaceable elements is well defined and predictable for each coupling orientation, with a first of the connectors assuming always the same state and the other assuming different states according to the coupling orientation. Various specific implementations of these features will be described below.

In most preferred implementations of the present invention, the various connectors are provided with shielding sleeves. These shielding sleeves are conductive sleeves of generally rectangular cross-section which are structurally and functionally similar to the corresponding sleeves of the standard USB plug and receptacle designs. In addition to an electrical shielding function, these sleeves typically play an important role in the mechanical engagement and structural stability of the engaged state of the connectors. Furthermore, the form of the shielding sleeves may be taken to define a "direction of mating" for each connector along which the connector moves as the inter-engaging sleeves slide against each other during mating. Since the shielding sleeves typically obscure most of the internal structure of the connectors, for clarity of illustration, many of the figures described below are shown with the shielding sleeves omitted.

Before addressing the specific embodiments in more detail, it will be useful to define certain terminology as used herein in the description and claims. Firstly, the terms "standard USB plug" and "standard USB receptacle" are used to refer to plugs and receptacles as defined by industry standards for the universal serial bus (USB) interface. Such standards are well known in the industry, and may be obtained from the USB Implementers Forum, Inc. (Beaverton, Oreg., USA).

The term "receptacle" is used to refer to the type of connector typically built-in to various host devices, such as PCs, and is defined herein by its ability to functionally mate with a standard USB plug. Similarly, the term "plug" is used to refer to the type of connector typically provided on a connecting lead or peripheral device for connection to a host, such as a PC, and is defined herein by its ability to functionally mate with a standard USB receptacle.

The term "connector" is used to refer generically to plugs and receptacles. The term "complementary connector" is used to refer to the type of connector with which a first connector is intended to mate. In other words, if the connector being referred to is a plug, the complementary connector is a receptacle, and vice versa.

The terms "functionally mated" and "functionally coupled" are used interchangeably to refer to mating of two connectors which achieves both mechanical engagement and electrical connection between contacts of the connectors, thereby providing the intended functionality of the connectors. Parenthetically, in the case of reversible connectors, it will be noted that correct connection of the contacts in each coupling orientation may be achieved in various ways, including use of cross-over patterns of fixed electrical connections or dynamic electronic switching. These options are described in detail in the '086 patent and will not be addressed here in detail.

Referring now to the drawings, FIGS. 1-9B and FIGS. 10-14B illustrate, respectively, the structure and function of two embodiments of the present invention for implementations of reversible USB connectors where the aforementioned displaceable element is a tongue element.

The phrase "tongue element" as used herein in the description and claims refers to a generally flat element (i.e., having two dimensions, "length" and "width", significantly greater than a third "thickness" dimension) which is movable, at least under certain conditions, in a direction generally parallel to its thickness dimension, i.e., roughly perpendicular to its two larger dimensions. The dimensions referred to are the outer dimensions of the element which may itself be an open structure with internal spaces or a solid structure. The movement of the tongue element or part thereof may be any suitable motion including, but not limited to, a roughly parallel motion, a flexing motion achieved through the flexibility of the tongue element itself and a pivotal movement about an effective pivot axis. The displacement is typically in a direction generally perpendicular to the aforementioned direction of mating of the connector.

Turning first to the embodiment of FIGS. 1-9B, this provides a first solution for mating in a well-defined and predictable manner the various "tongue assembly" embodiments of the '086 patent. This embodiment illustrates an approach predicated on the observation that the internal contact block of a standard USB plug (or receptacle) has a chamfered edge and is set slightly to one side of the plane of symmetry of the shielding sleeve. As a result, a reversible USB connector operating on the principles of the tongue assembly embodiments of the '086 patent will still be operative to receive a standard USB connector in either orientation even if the leading edge is offset from the plane of symmetry by a fraction of a millimeter (e.g., 0.3 mm or even 0.5 mm). When the same connector meets a complementary reversible connector with a leading edge which is substantially on the plane of symmetry, the offset leading edge defines a preferred direction of deflection. Thus, for example, by using a slight offset in the receptacle, a preferred direction of deflection is defined for the meeting of two such reversible USB connectors, allowing them to mate reliably in either relative orientation without jamming, while still providing reversible functionality when either is used separately to mate with a conventional USB connector.

The structure of a connector with an offset leading edge according to this embodiment is best seen in FIG. 1. The pre-selected one of the reversible connectors, in this case a reversible receptacle 100, is configured to assume its neutral configuration with the tongue element 102 providing a leading edge 104 located with a marginal offset "d" from a central position 106 relative to the shielding sleeve. In FIG. 1, the shielding sleeve itself is omitted for clarity, but the positions of its upper and lower walls are indicated by dashed lines 108.

The term "marginal offset" is used in this context to refer to a small offset which is sufficient to generate a preferred direction of deflection when leading edge 104 meets a centrally disposed edge, but is small enough to avoid leading edge 104 colliding with front surface beyond the chamfered edge of the contact block of the complementary standard USB connector. In practice, an offset d of between about 0.3 and about 0.5 millimeter is believed to be appropriate.

Although the marginal offset may be generated by a slight asymmetrical offset of the entire tongue assembly within the shielding sleeve, it is believed to be preferable that the main body of the tongue assembly is biased to a central neutral position and that the offset is provided by appropriate shaping of tip block 110 to provide asymmetrically positioned leading edge 104.

In other respects, reversible USB receptacle 100 and the complementary reversible USB plug 150 (FIGS. 3A-6B) are generally similar to the corresponding embodiments described in the '086 patent, including a set of four upper contact strips 112, a set of four lower contact strips 114, an interposed insulating layer 116 integrally formed with tip block 110 and a cross-over electrical connection arrangement 118. A shielding sleeve 120, only shown in selected views, surrounds each of the tongue assemblies and is sized to mate with the complementary standard USB connector. In the case of the reversible USB receptacle 100, the contact strips are formed with insulated contact-deflecting features 122. All of these features are described in more detail in the '086 patent and will not be addressed further here.

Figure 6B:
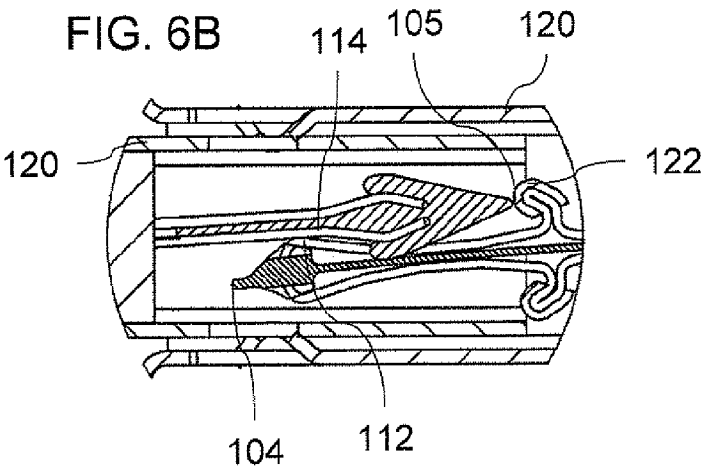
FIG. 6B is a view similar to FIG. 6A showing a fully engaged state of the connectors.
Figure 6A:
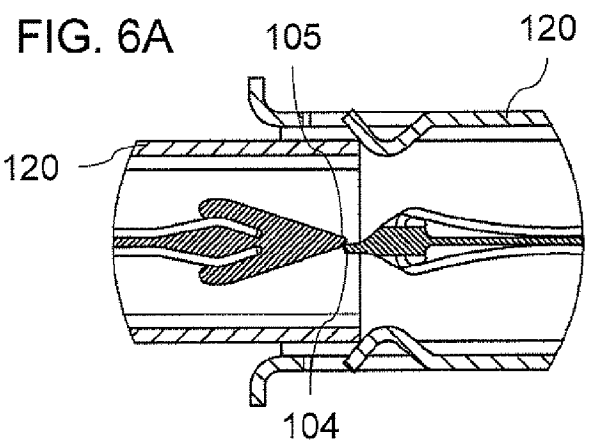
FIG. 6A is an enlarged view of the region of FIG. 5 identified as "B"
Figure 7:
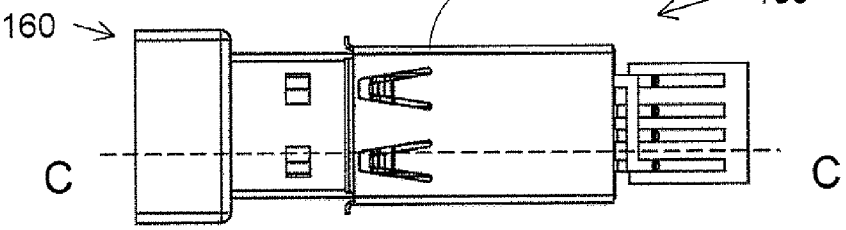
FIG. 7 is a plan view of the reversible connector of FIG. 1 in the initial stage of mating with a standard USB type-A connector.
Figure 8:
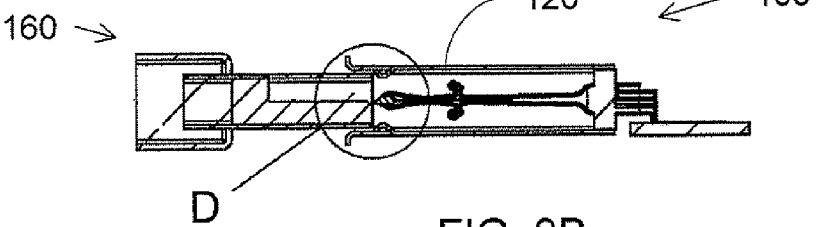
FIG. 8 is a cross-sectional view taken along the line C-C in FIG. 7.

FIGS. 3A-6B show the process of mating reversible USB plug 150 with reversible USB receptacle 100. In FIGS. 3A, 4, 5 and 6A, the two connectors are shown as they initially come together. As leading edge 104 comes into contact with the opposing leading edge 105 disposed on the plane of symmetry, the offset causes edge 104 to lodge below edge 105 in the views as shown, thereby defining a preferred direction of deflection for the subsequent motion. As the connectors are moved closer together, both tongue elements are deflected, in a manner similar to the deflection when engaging a standard connector, until they achieve functional connection as shown in FIGS. 3B and 6B. It will be appreciated that if reversible USB plug 150 is inverted, the deflection of the tongue elements will remain unchanged, whereas if reversible USB receptacle 100 is inverted the direction of deflection would be upwards for the receptacle as shown and downwards for the plug as shown.

Figure 9B:
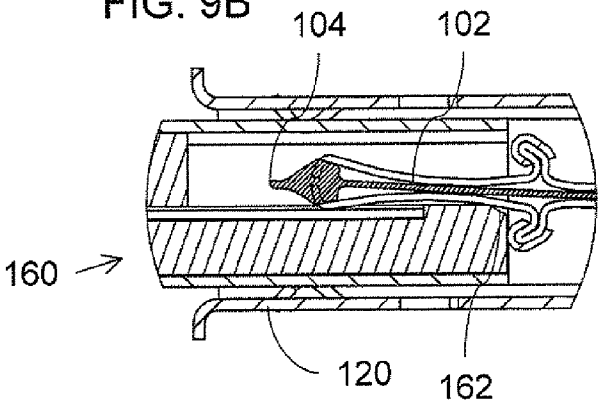
FIG. 9B is a view similar to FIG. 9A showing a fully engaged state of the connectors.
Figure 9A:
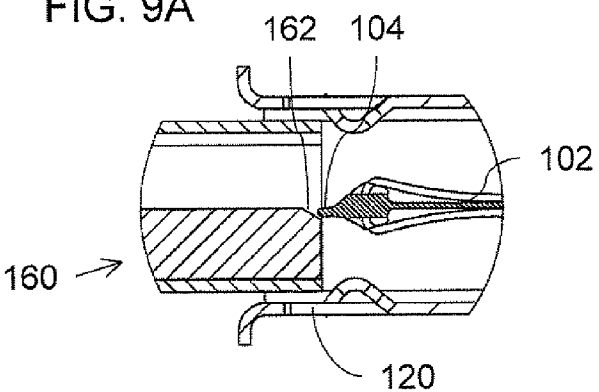
FIG. 9A is an enlarged view of the region of FIG. 8 identified as "D"
Figure 10:
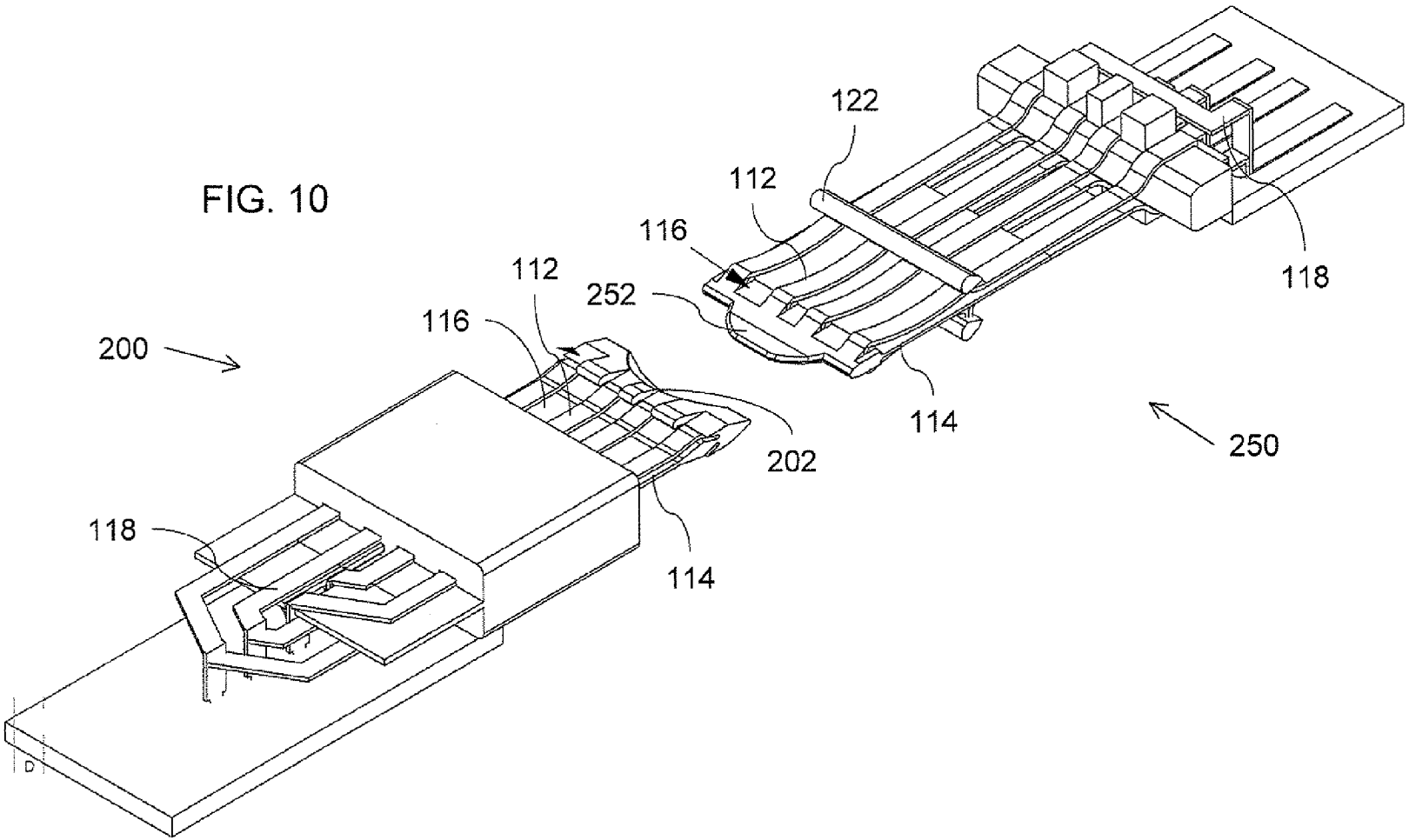
FIG. 10 is an isometric view of a system, constructed and operative according to a second embodiment of the present invention, including a pair of reversible USB type-A connectors for functionally mating with each other and with standard USB type-A connectors, the reversible connectors being shown with the shielding sleeves omitted for clarity of presentation.
Figure 11:
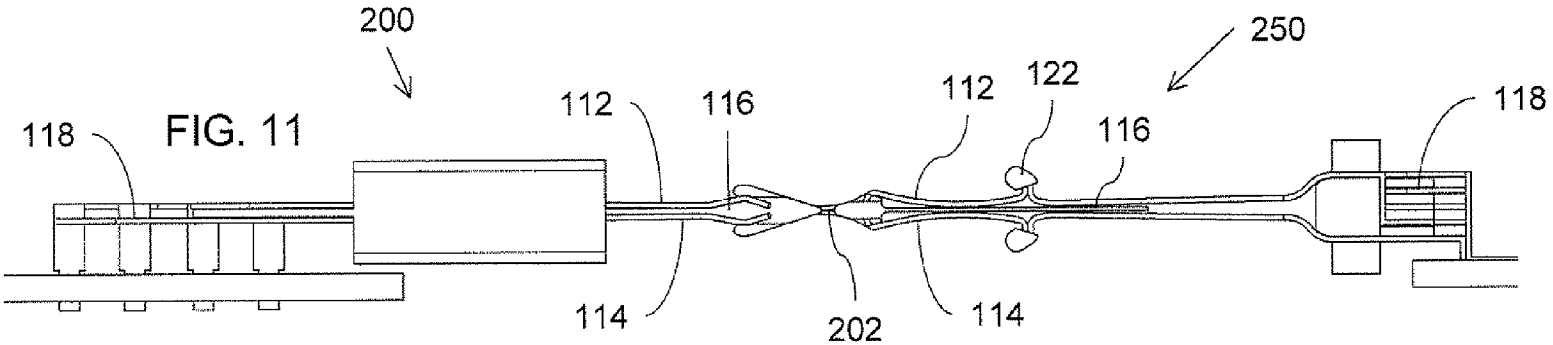
FIGS. 11 and 12 are side and plan views, respectively, of the pair of reversible connectors of FIG. 10 in the initial stage of mating with each other, again with the shielding sleeves omitted.
Figure 12:
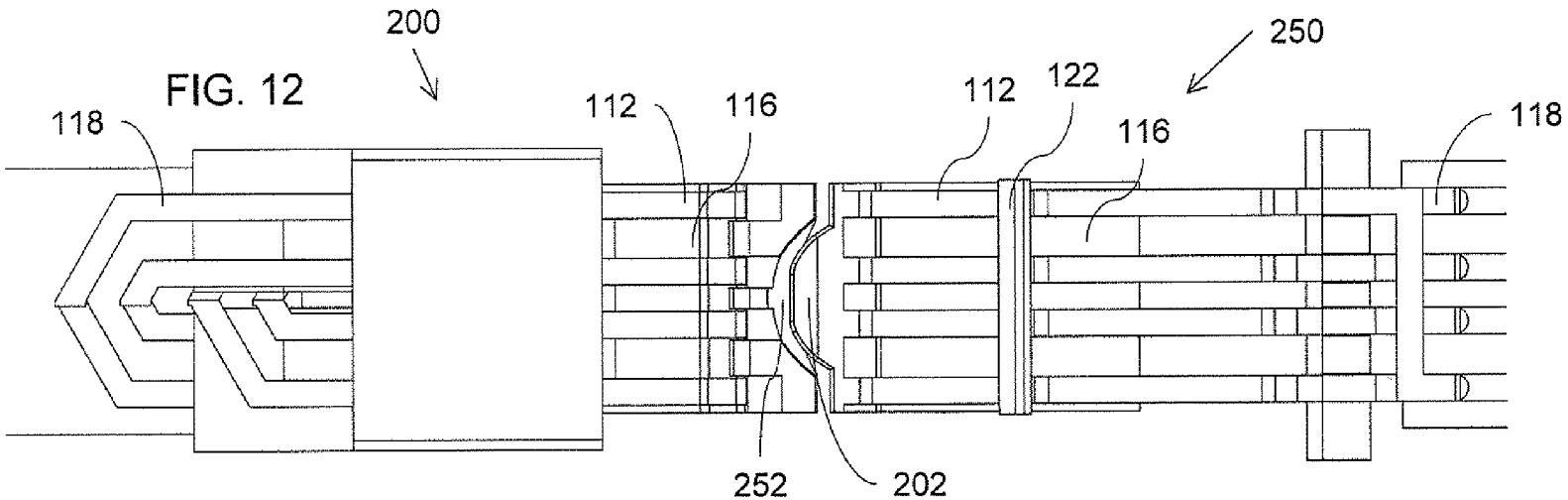

As mentioned above, the marginal offset of leading edge 104 is sufficiently small that it does not interfere with reversible mating with a standard plug. This is illustrated in FIGS. 7-9B which show mating of a standard USB plug 160 with reversible USB receptacle 100. As best seen in FIG. 9A, despite the marginal offset, edge 104 comes into contact with the chamfered edge 162 of the contact block of standard USB plug, thereby being lifted to ride up over the contact block in the same manner as the receptacles of the '086 patent to reach a final position as shown in FIG. 9B.

Turning now to a second embodiment of the present invention, this will be illustrated with reference to FIGS. 10-14B, and provides an alternative solution for achieving mating of the various "tongue assembly" embodiments of the '086 patent in a well-defined and predictable manner. This embodiment is predicated on the observation that the surfaces cooperating during initial engagement of a conventional USB plug and receptacle are essentially continuous surfaces extending across the entire width of the plug and receptacle, perpendicular to the direction of insertion. As a result, the leading edges of the reversible plug and/or receptacle do not need to extend across the entire width in order to reliably engage the conventional connector surfaces.

Based on this observation, it has been found that a reversible connector, in this case reversible plug 200, can be implemented generally according to the embodiment of FIGS. 1a-1f of the '086 patent but with a recessed region, in this case shown as a central concave recess 202, without interfering with the interaction of the plug with a standard USB receptacle. The internal surface of recess 202 does not interact during mating with a standard receptacle, and can therefore be formed with any desired inclination. In this case, it is formed with an incline of between 10 degrees and 80 degrees, and most preferably in the range of 30-60 degrees, to the plane of symmetry of the tongue element.

Figure 13A:
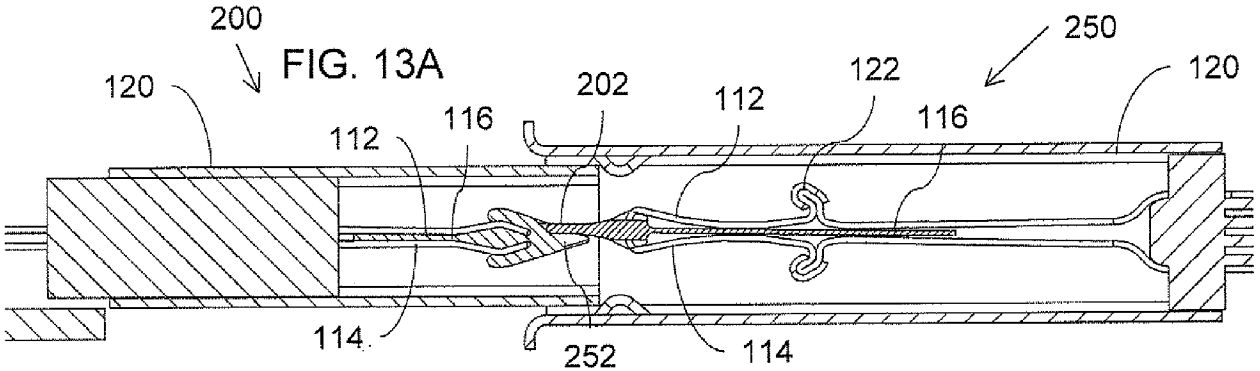
FIG. 13A is a cross-sectional view taken along a central plane through the mating reversible connectors of FIG. 10 after slight additional advancing of the engagement.
Figure 13B:
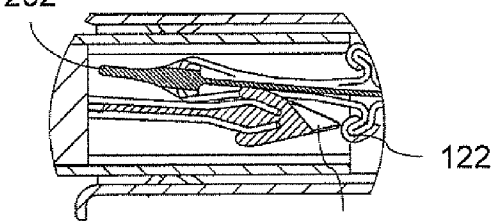
FIG. 13B is a partial view similar to FIG. 13A showing a fully engaged state of the connectors.
Figure 14B:
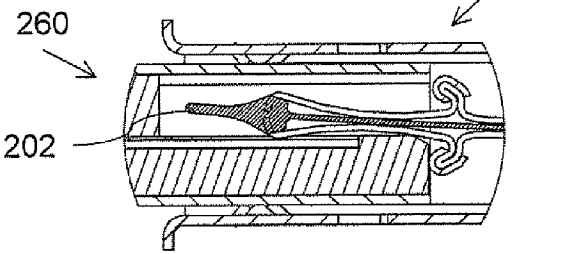
FIGS. 14A and 14B are partial cross-sectional views taken along a central plane during mating of one of the connectors of FIG. 10 with a standard USB type-A connector during the initial stage of engagement and in a fully engaged state, respectively.
Figure 14A:
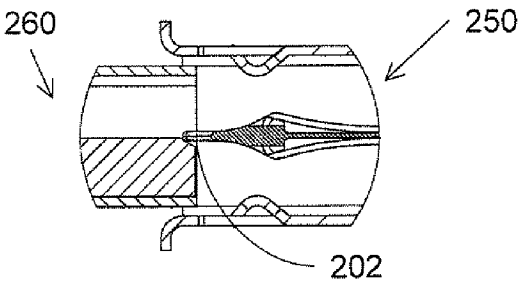

The complementary reversible connector for this embodiment, in this case reversible receptacle 250, is formed generally similarly to the embodiment of FIGS. 2a-2m of the '086 patent but with a forward projecting tab 252. Since leading edge tab 252 is configured with its leading edge on the plane of symmetry of the tongue element, it does not interfere with normal operation of reversible receptacle 250 when mating with a standard USB plug. Leading tab 252 is configured such that, when mating with reversible plug 200 as shown in FIGS. 11-13B, leading tab 252 contacts the inclined rear surface of recess 202 before engaging the leading edge of plug 200. The contact of tab 252 with the inclined surface ensures a well defined direction of relative deflection for the tongues of both the plug and the receptacle, thereby allowing reliable engagement without jamming. The sequence of motion occurring on engagement of reversible plug 200 with reversible receptacle 250 is illustrated in FIGS. 13A and 13B. Clearly, the direction of deflection of the tongue element of reversible receptacle 250 is determined by the orientation of reversible plug 200, and does not vary under inversion of receptacle 250. At the same time, both reversible plug 200 and reversible receptacle 250 individually maintain their capability of mating with a complementary standard USB connector in either orientation. By way of example, FIGS. 14A and 14B illustrate mating of a standard USB plug 260 with reversible receptacle 250.

Other than the specific features described above, both reversible plug 200 and reversible receptacle 250 are similar to reversible USB plug 150 and reversible USB receptacle 100 described above, and equivalent elements are labeled similarly. Here again, the structure and function of additional features of the connectors may be understood by analogy to the corresponding embodiments of the '086 patent.

Turning now to the third and fourth exemplary embodiments, these provide solutions for predictable and reliable mating of reversible USB connectors for implementations of reversible USB connectors where the aforementioned at least one displaceable element are implemented as a pair of retractable slides or blocks. Implementations of this type are described in the '086 patent with reference to FIGS. 4a-4g and 8a-8g thereof, and employ two sliding blocks (referred to here concisely as "slides") which are biased to a forward position corresponding to the "neutral configuration" and are individually retractable in a direction roughly parallel to the direction of insertion. During mating with a complementary conventional connector, one or other of the slides is displaced rearwards by contact with the contact block of the conventional connector, exposing the contact strips of the other slide which remains in its forward position, thereby assuming the first or second "displaced configuration."

Figures 15A, 15B, 15C:
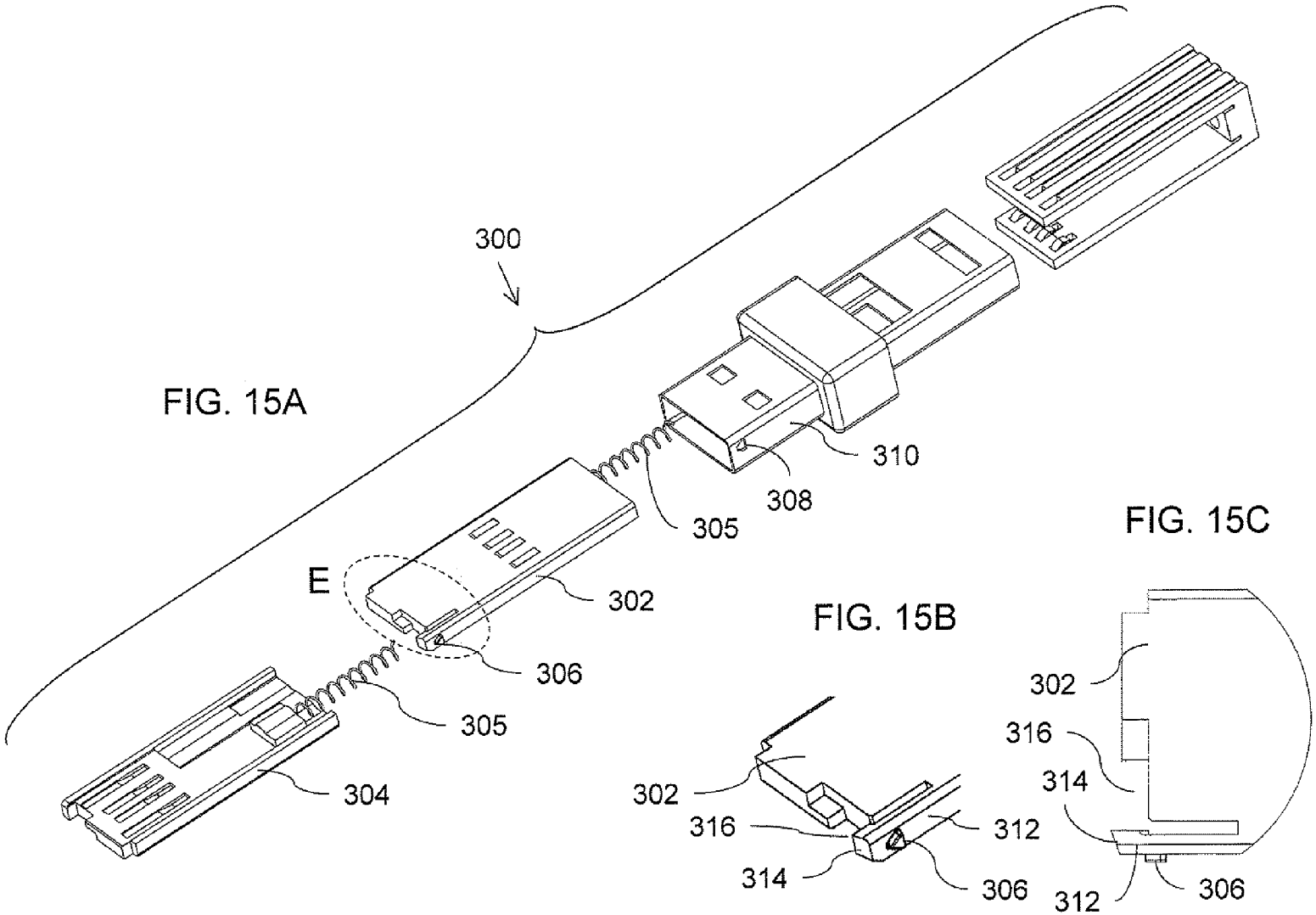
FIG. 15A is an exploded isometric view of a reversible USB type-A plug, constructed and operative according to a third embodiment of the present invention.
FIG. 15B is an enlarged view of the region of FIG. 15A designated "E" showing an end portion of a retractable slide.
FIG. 15C is a plan view of the end portion of the retractable slide of FIG. 15B.

Turning now to FIGS. 15A-23, there is shown a third embodiment of the present invention for ensuring predictable and reliable functional mating of two such retractable-slide reversible connectors. Specifically, FIG. 15A shows a reversible connector, in this case implemented as a reversible plug 300, constructed and operative according to the teachings of the present invention. Reversible plug 300 includes a first retractable slide 302 and a second retractable slide 304, each biased to a forward position by a resilient biasing arrangement such as a helical spring 305. First retractable slide 302 is formed with at least part of a detent arrangement deployed to provide a threshold of resistance to oppose displacement of the first retractable slide from its neutral position to its retracted position. As shown here, the detent arrangement is preferably provided by a lateral projection 306 projecting from retractable slide 302 and a corresponding recess 308 formed in a shielding sleeve 310 of reversible plug 300.

As best seen in the enlarged views of FIGS. 15B and 15C, lateral projection 306 is preferably arranged on a spring element 312 which may be integrally formed with first slide 302.

When a force greater than the threshold of resistance is applied to first slide 302, spring element 312 flexes to allow lateral projection 306 to clear recess 308, freeing first slide 302 to retract.

In certain embodiments of the present invention, a simple resilient detent arrangement as described thus far may be sufficient to provide predictable and reliable mating of reversible plug 300 with a complementary retractable-slide reversible receptacle. Specifically, if the springs used for the receptacle are significantly stronger (i.e., have a larger spring constant) than those of reversible plug 300, the slide of the receptacle meeting second slide 304 will cause second slide 304 to retract while the threshold of resistance generated by lateral projection 306 engaged in recess 308 may be designed to be sufficient to prevent first slide 302 from retracting. However, in order to further enhance the reliability of the arrangement, certain particularly preferred implementations of the present invention include one or both of: (a) an arrangement to reduce the threshold of resistance encountered when first slide 302 encounters a contact block of a conventional USB receptacle; and (b) a positive locking arrangement for locking first slide 302 against retraction when engaged with a complementary reversible receptacle according to the teachings of the present invention. These preferred options will now be discussed in more detail.

Turning first to the arrangement to reduce the threshold of resistance encountered when first slide 302 encounters a contact block of a conventional USB receptacle, it will be noted in FIGS. 15B and 15C that a preferred form of spring element includes an angled tip 314 which projects slightly beyond the leading edge of the main body of slide 302. The effect of projecting angled tip 314 during mating with a conventional USB receptacle is illustrated in FIGS. 16A-17B.

Figure 16A:
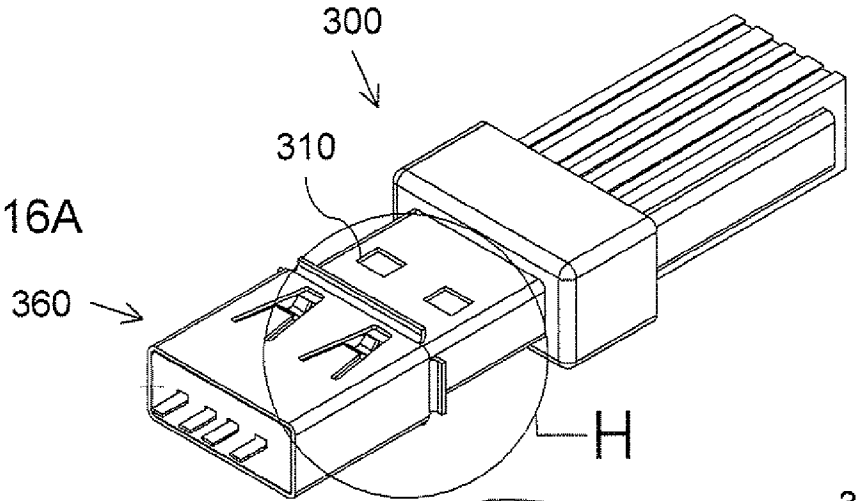
FIG. 16A is an isometric view of the plug of FIG. 15A during mating with a standard USB type-A receptacle.
Figure 16B:
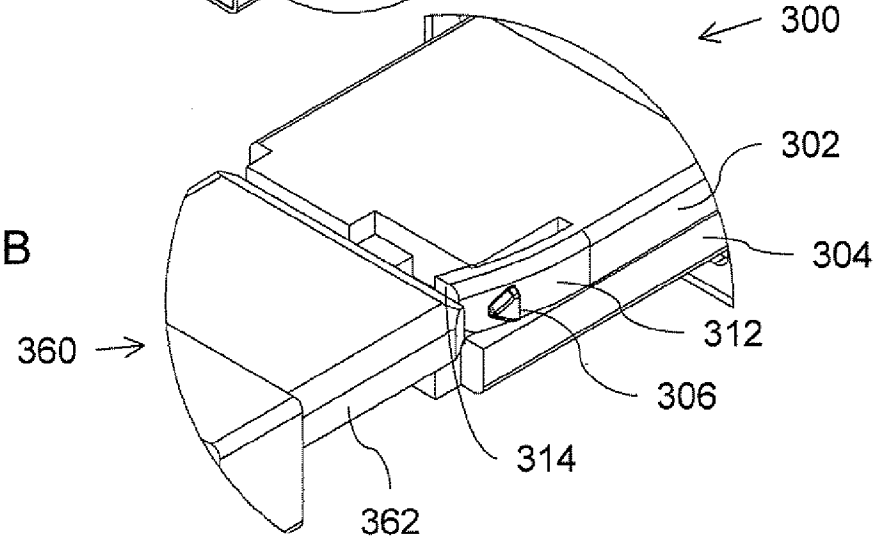
FIG. 16B is an enlarged view of the region of FIG. 16A designated "H" with the shielding sleeves omitted for clarity.
Figure 17A:
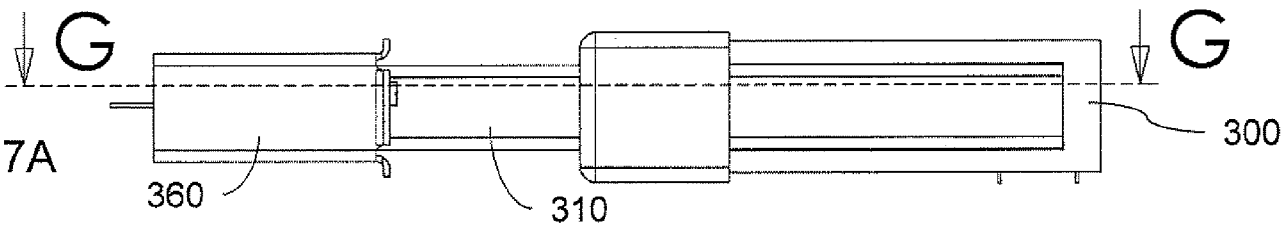
FIG. 17A is a plan view of the plug of FIG. 15A during mating with a standard USB type-A receptacle.
Figure 17B:
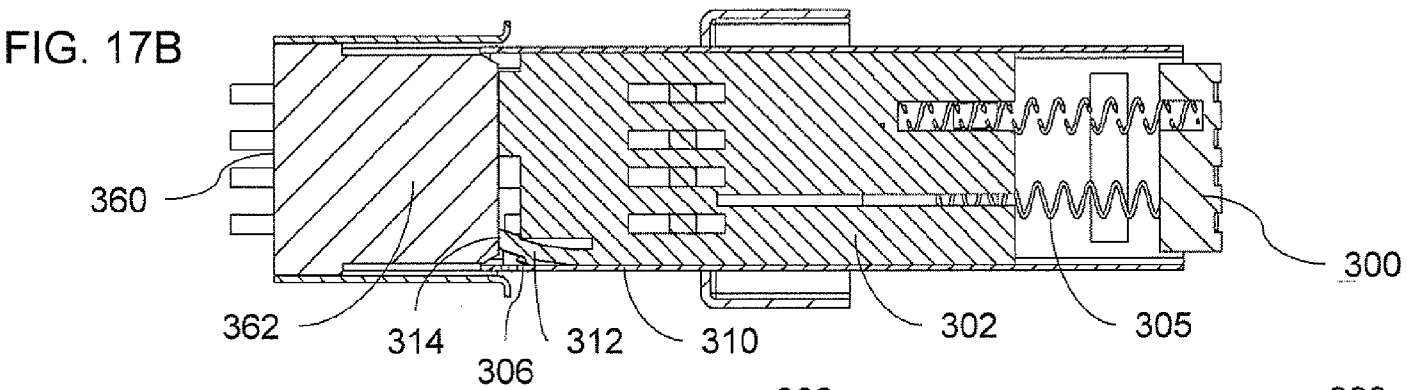
FIG. 17B is a cross-sectional view taken along the line G-G in FIG. 17A.
Figure 18:
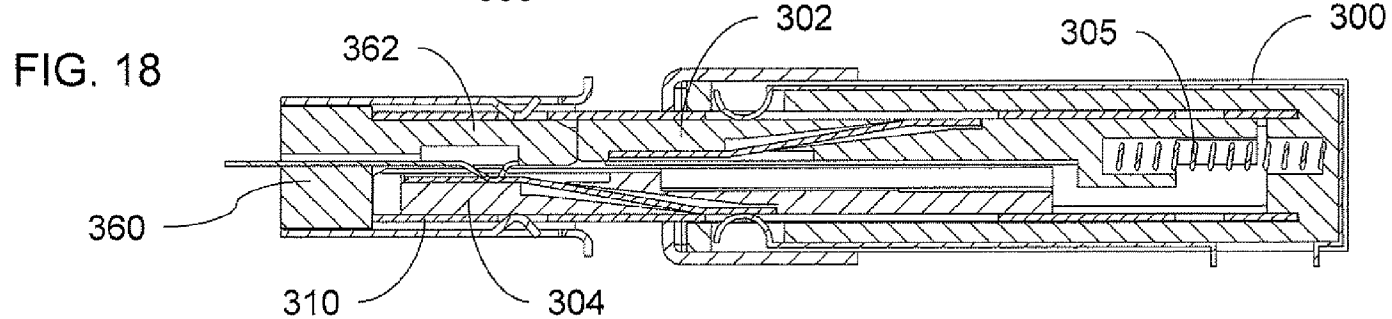
FIG. 18 is a vertical cross-sectional view the plug of FIG. 15A when fully mated with a standard USB type-A receptacle.

Specifically, as best seen in FIGS. 16B and 17B, when reversible USB plug 300 starts to mate with a conventional USB receptacle 360 with first slide 302 opposite the contact block 362 of receptacle 360, initial contact of projecting angled tip 314 with contact block 362 causes deflection of spring element 312 inwards towards the midline of plug 300. This deflection at least partially disengages lateral projection 306 from recess 308, thereby reducing or eliminating the threshold of resistance of first slide 302 to retraction. First slide 302 is then pushed back to its retracted position by contact block 362 as the connectors move together until reaching the fully-engaged and functionally mated state shown in FIG. 18.

Figures 19A, 19B:
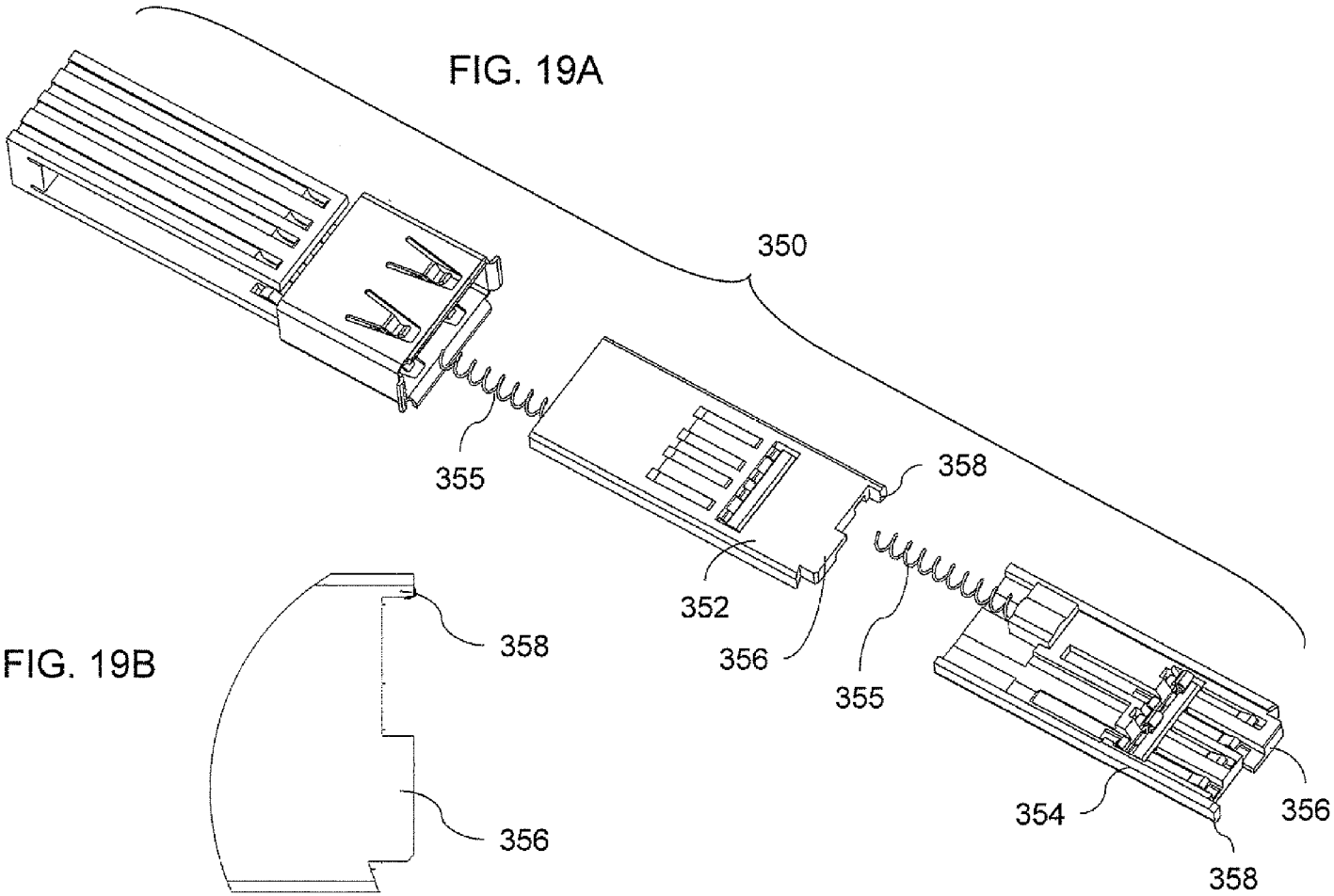
FIG. 19A is an exploded isometric view of a reversible USB type-A receptacle, constructed and operative according to a third embodiment of the present invention, for mating with both a standard USB type-A plug and the plug of FIG. 15A.
FIG. 19B is an enlarged plan view of the end of a retractable slide from the receptacle of FIG. 19A.
Figure 21A:
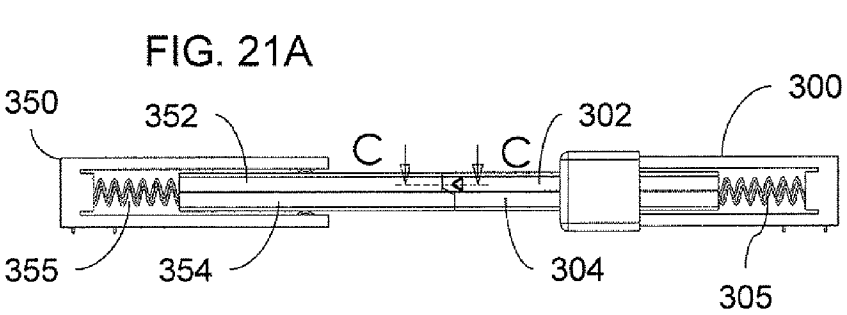
FIG. 21A is a side view of the plug of FIG. 15A during mating with the receptacle of FIG. 19A, with the shielding sleeves omitted for clarity.
Figure 21B:
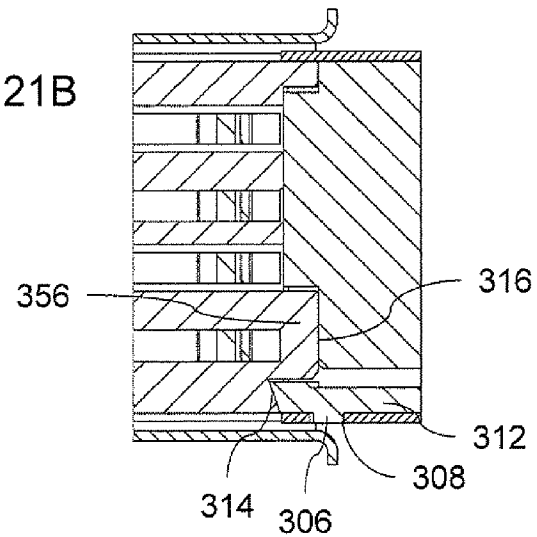
FIG. 21B is a partial cross-sectional view taken along the line C-C in FIG. 21A.
Figure 20A:
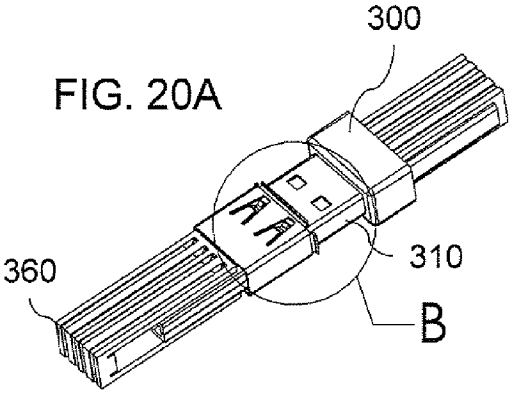
FIG. 20A is an isometric view of the plug of FIG. 15A during mating with the receptacle of FIG. 19A.
Figure 20B:
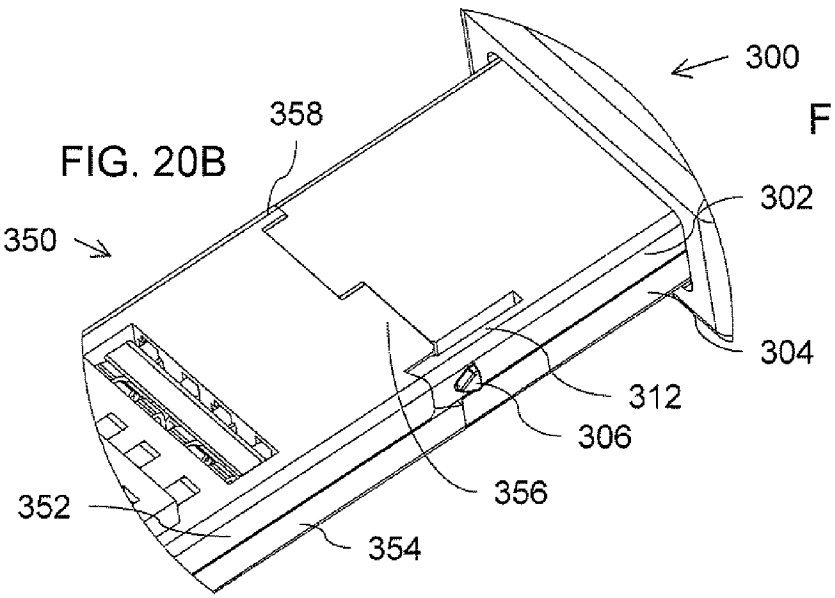
FIG. 20B is an enlarged view of the region of FIG. 20A designated "B" with the shielding sleeves omitted for clarity.

Turning now to the aforementioned positive locking arrangement, this will now be described with reference to FIGS. 19A-23. FIG. 19A shows a reversible receptacle 350, constructed and operative according to the teachings of the present invention, for mating with a standard USB plug or with reversible plug 300. Reversible receptacle 350 has two retractable slides 352 and 354 which are both formed with a projecting feature 356 such that, in each coupling orientation relative to reversible plug 300, one of projecting features 356 engages spring element 312 of retractable slide 302 so as to inhibit flexing of the spring element. As a result, lateral projection 306 is locked in engagement with recess 308, thereby preventing retraction of first slide 302 relative to shielding sleeve 310.

Figure 22:
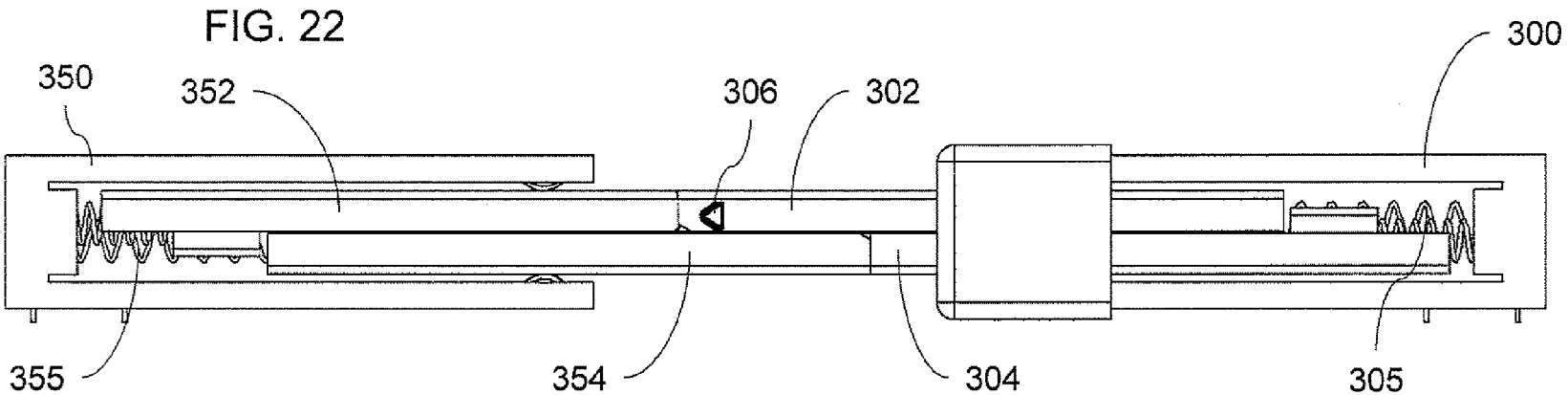
FIG. 22 is a side view of the plug of FIG. 15A fully mated with the receptacle of FIG. 19A, with the shielding sleeves omitted for clarity.
Figure 23:
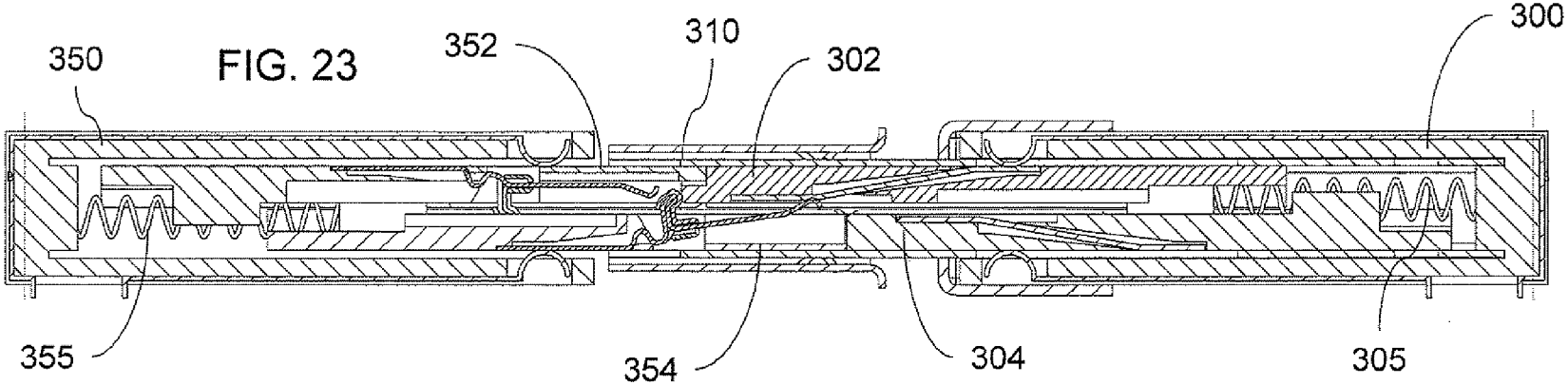
FIG. 23 is a vertical cross-sectional view taken through the plug of FIG. 15A when fully mated with the receptacle of FIG. 19A.

In the particularly preferred implementation illustrated here, projecting feature 356 is a relatively wide projection extending across at least a quarter of the width of slides 352 and 354. When mating with a standard USB plug, projecting feature 356 and an additional projection 358 near the other side of the slides together provide the leading edge of the slide which abuts the contact block of the standard USB plug. When mating with reversible plug 300, projecting feature 356 engages a corresponding opening 316 (see FIGS. 15B and 15C) adjacent to spring element 312, thereby forming an interlocking configuration as shown in FIGS. 20A-21B. The presence of projecting feature 356 spanning the width of opening 316 prevents inward displacement of spring element 312, thereby locking first slide 302 of reversible USB plug 300 against retraction. Second slide 304, on the other hand, remains free to retract against the bias of its helical spring 305. By providing the slides of reversible USB receptacle 350 with a biasing arrangement (helical springs 355) significantly stronger (i.e., with a larger spring constant) than those of reversible USB plug 300, the mated configuration of plug 300 and receptacle 350 becomes well defined as illustrated in FIGS. 22 and 23, with slide 302 remaining extended to push pack its opposing slide, in this case, slide 352 of the receptacle, and slide 304 being pushed back by its opposing slide, in this case, slide 354 of the receptacle.

In all other respects, the structure and function of reversible USB plug 300 and reversible USB receptacle 350 are analogous to the corresponding embodiments of the '086 patent, and will not be addressed here.

Turning finally to a fourth embodiment of the present invention, it will be noted that an alternative solution for ensuring predictable and reliable mating of reversible retractable-slide-type USB plugs and receptacles may be implemented with minimal modification of the embodiments of the '086 patent simply by ensuring a predefined relationship between the spring constants of the biasing arrangements of the slides. Specifically, according to this embodiment, the first and second retractable slides of one of the connectors are biased, respectively, from the corresponding retracted positions to the initial positions by corresponding first and second springs, and the first and second retractable slides of the other of the connectors are biased, respectively, from the corresponding retracted positions to the initial positions by corresponding third and fourth springs. The first, second, third and fourth springs are implemented so as to exhibit respective spring constants K1, K2, K3 and K4 satisfying the following conditions:

K1 is greater than both K3 and K4; and

K2 is smaller than both K3 and K4.

Preferably, K3 is substantially equal to K4.

In order to ensure proper operation, the differential between K1 and K3, and between K3 and K2, should be sufficient to overcome frictional resistance. Thus K1 should be significantly greater than K2, i.e., with sufficient differential between them to allow K1>K3>K2 with enough margin to overcome friction.

By ensuring sufficient differentials between the stiffness of the springs according to these interrelations, the first slide of the first reversible connector will always resist significant retraction during mating with the second reversible connector, instead pushing back its opposing slide, whereas the second slide of the first reversible connector will be pushed back by the opposing slide of the second reversible connector. When encountering a complementary standard USB connector, on the other hand, any of the slides would be pushed back on coming in contact with the fixed contact block of the standard connector, thereby maintaining the required basic functionality of the reversible connectors.

It will be appreciated that the above descriptions are intended only to serve as examples, and that many other embodiments are possible within the scope of the present invention as defined in the appended claims.

What is claimed is:

1. A system comprising:

(a) a reversible plug for functionally mating with a standard USB type-A receptacle in each of two coupling orientations, said reversible plug including at least one displaceable element, said at least one displaceable element assuming:

(i) a neutral configuration prior to coupling with the standard USB receptacle, (ii) a first displaced configuration when coupled with the standard USB receptacle in a first coupling orientation, and (iii) a second displaced configuration when coupled with the standard USB receptacle in a second coupling orientation; and (b) a reversible receptacle for functionally mating with a standard USB type-A plug in each of two coupling orientations, said reversible receptacle including at least one displaceable element, said at least one displaceable element assuming:

(i) a neutral configuration prior to coupling with the standard USB plug, (ii) a first displaced configuration when coupled with the standard USB plug in a first coupling orientation, and (iii) a second displaced configuration when coupled with the standard USB plug in a second coupling orientation, wherein said reversible plug and said reversible receptacle are further adapted for functionally mating with each other in each of two relative coupling orientations such that said at least one displaceable element of a pre-selected one of said reversible plug and said reversible receptacle assumes the corresponding first displaced configuration independent of the relative coupling orientation between said reversible plug and said reversible receptacle.

2. The system of claim 1, wherein each of said reversible plug and said reversible receptacle includes a shielding sleeve, each of said shielding sleeves defining a corresponding direction of mating, and wherein said at least one displaceable element of each of said reversible plug and said reversible receptacle includes a tongue element displaceable in a direction perpendicular to said corresponding direction of mating.

3. The system of claim 2, wherein, when said pre-selected one of said reversible plug and said reversible receptacle assumes the corresponding neutral configuration, said tongue element provides a leading edge located with a marginal offset from a central position relative to said shielding sleeve.

4. The system of claim 2, wherein said tongue element of said pre-selected one of said reversible plug and said reversible receptacle has a leading edge deployed, when in the corresponding neutral configuration, in a substantially central position within said shielding sleeve, and wherein said tongue element further includes a recessed region including an inclined deflector surface, and wherein said tongue of the other of said reversible plug and said reversible receptacle has a leading projection configured to impinge on said deflector surface during mating of said reversible plug and said reversible receptacle.

5. The system of claim 1, wherein said at least one displaceable element of each of said reversible plug and said reversible receptacle includes a pair of retractable slides assuming an initial position in said neutral configuration, a first of said slides being displaceable to a retracted position to form said first displaced configuration, and a second of said slides being displaceable to a retracted position to form said second displaced configuration.

6. The system of claim 5, wherein said first retractable slide of said pre-selected one of said reversible plug and said reversible receptacle is formed with at least part of a detent arrangement deployed to provide a threshold of resistance to oppose displacement of said first retractable slide from said neutral position to said retracted position.

7. The system of claim 6, wherein said pre-selected one of said reversible plug and said reversible receptacle is said reversible plug, and wherein said reversible plug includes a shielding sleeve, said detent arrangement including a lateral projection and corresponding recess formed in said shielding sleeve and said first retractable slide.

8. The system of claim 7, wherein said lateral projection is arranged on a spring element integrally formed with said first slide, said wherein said spring element flexes on exertion of force greater than said threshold of resistance to allow said lateral projection to clear said corresponding recess.

9. The system of claim 8, wherein both of said first and second slides of said reversible receptacle are formed with a projecting feature such that, in each of the relative coupling orientations, one of said projecting features engages said spring element so as to inhibit flexing of said spring element.

10. The system of claim 5, wherein said first and second retractable slides of said pre-selected one of said reversible plug and said reversible receptacle are biased, respectively, from said corresponding retracted positions to said initial positions by corresponding first and second springs, and wherein said first and second retractable slides of the other of said reversible plug and said reversible receptacle are biased, respectively, from said corresponding retracted positions to said initial positions by corresponding third and fourth springs, each of said first, second, third and fourth springs having a corresponding spring constant K1, K2, K3 and K4 such that:

(a) K1 is greater than both K3 and K4; and (b) K2 is smaller than both K3 and K4.

11. The system of claim 10, wherein K3 is substantially equal to K4.

12. A system comprising a reversible connector for functionally mating with a standard USB type-A connector in each of two coupling orientations, said reversible connector including:

(a) a shielding sleeve defining a direction of mating, and (b) a tongue element deployed within said shielding sleeve and displaceable in a direction perpendicular to said corresponding direction of mating between:

(i) a neutral position prior to coupling with the standard USB connector, (ii) a first displaced position when coupled with the standard USB connector in a first coupling orientation, and (iii) a second displaced position when coupled with the standard USB connector in a second coupling orientation, wherein said reversible connector is configured such that, when said tongue element assumes said neutral position, said tongue element provides a leading edge located with a marginal offset from a central position relative to said shielding sleeve, said marginal offset being such that, when said reversible connector mates with the standard USB connector in either coupling orientation, said tongue element is displaced by engagement with the standard USB connector towards a corresponding one of said first and second displaced positions and, when said reversible connector mates with a non-standard connector having a centrally positioned leading edge, said tongue element is always displaced towards said second displaced position.

13. The system of claim 12, wherein a major part of said tongue element is deployed substantially centrally within said shielding sleeve and said leading edge is provided by an asymmetric edge portion.

14. The system of claim 12, wherein said reversible connector is a reversible receptacle for functionally mating with a standard USB type-A plug.

15. The system of claim 12, wherein said reversible connector is referred to as said first reversible connector, the system further comprising a second reversible connector for functionally mating in each of two coupling orientations with each of said first reversible connector and a standard USB type-A connector complementary to that with which said first reversible connector functionally mates, said second reversible connector including:

(a) a shielding sleeve defining a direction of mating, and (b) a tongue element deployed within said shielding sleeve and displaceable in a direction perpendicular to said corresponding direction of mating between:

(i) a neutral position prior to coupling with the standard USB connector, (ii) a first displaced position when coupled with the standard USB connector in a first coupling orientation, and (iii) a second displaced position when coupled with the standard USB connector in a second coupling orientation, wherein said tongue element of said second reversible connector, when in said neutral position, presents a leading edge substantially centrally positioned relative to said shielding sleeve.

16. A system comprising a reversible connector for functionally mating with a standard USB type-A connector in each of two coupling orientations, said reversible connector including:

(a) a shielding sleeve defining a direction of mating, and (b) a tongue element deployed within said shielding sleeve and displaceable in a direction perpendicular to said corresponding direction of mating between:

(i) a neutral position prior to coupling with the standard USB connector, (ii) a first displaced position when coupled with the standard USB connector in a first coupling orientation, and (iii) a second displaced position when coupled with the standard USB connector in a second coupling orientation, wherein said tongue element has a leading edge deployed, when in the corresponding neutral configuration, in a substantially central position within said shielding sleeve, and wherein said tongue element further includes a recessed region including an inclined deflector surface, such that, when said reversible connector mates with the standard USB connector in either coupling orientation, said tongue element is displaced by engagement of said leading edge with the standard USB connector towards a corresponding one of said first and second displaced positions and, when said reversible connector mates with a non standard connector having a leading projection deployed to impinge on said deflector surface, said tongue element is always displaced towards said second displaced position.

17. The system of claim 16, wherein said reversible connector is referred to as said first reversible connector, the system further comprising a second reversible connector for functionally mating in each of two coupling orientations with each of said first reversible connector and a standard USB type-A connector complementary to that with which said first reversible connector functionally mates, said second reversible connector including:

(a) a shielding sleeve defining a direction of mating, and (b) a tongue element deployed within said shielding sleeve and displaceable in a direction perpendicular to said corresponding direction of mating between:

(i) a neutral position prior to coupling with the standard USB connector, (ii) a first displaced position when coupled with the standard USB connector in a first coupling orientation, and (iii) a second displaced position when coupled with the standard USB connector in a second coupling orientation, wherein said tongue of said second reversible connector has a leading projection configured to impinge on said deflector surface during mating of said first and second reversible connectors.

18. A system comprising a reversible connector for functionally mating with a standard USB type-A connector in each of two coupling orientations, said reversible connector including:

(a) a shielding sleeve defining a direction of mating, and (b) a pair of retractable slides each assuming an initial position and selectively retractable parallel to said direction of mating to a retracted position, said pair of slides assuming:

(i) a neutral configuration, prior to coupling with the standard USB connector, in which both of said slides are in said initial position, (ii) a first displaced configuration, when coupled with the standard USB connector in a first coupling orientation, in which a first of said slides is in said retracted position, and (iii) a second displaced configuration, when coupled with the standard USB connector in a second coupling orientation, in which a second of said slides is in said retracted position, wherein said first retractable slide is formed with at least part of a detent arrangement deployed to provide a threshold of resistance to oppose displacement of said first retractable slide from said neutral position to said retracted position.

19. The system of claim 18, wherein said reversible connector is a reversible plug, and wherein said detent arrangement includes a lateral projection and corresponding recess formed in said shielding sleeve and said first retractable slide.

20. The system of claim 19, wherein said lateral projection is arranged on a spring element integrally formed with said first slide, said wherein said spring element flexes on exertion of force greater than said threshold of resistance to allow said lateral projection to clear said corresponding recess.

21. The system of claim 20, further comprising a reversible receptacle for functionally mating in each of two coupling orientations with each of said reversible plug and a standard USB type-A plug, said reversible receptacle including:

(a) a shielding sleeve defining a direction of mating; and (b) a pair of retractable slides each assuming an initial position and selectively retractable parallel to said direction of mating to a retracted position, said pair of slides assuming:

(i) a neutral configuration, prior to coupling with the standard USB plug, in which both of said slides are in said initial position, (ii) a first displaced configuration, when coupled with the standard USB plug in a first coupling orientation, in which a first of said slides is in said retracted position, and (iii) a second displaced configuration, when coupled with the standard USB plug in a second coupling orientation, in which a second of said slides is in said retracted position, wherein both of said first and second slides of said reversible receptacle are formed with a projecting feature such that, in each of the relative coupling orientations, one of said projecting features engages said spring element so as to inhibit flexing of said spring element.

22. The system of claim 18, wherein said reversible connector is referred to as said first reversible connector, the system further comprising a second reversible connector for functionally mating in each of two coupling orientations with each of said first reversible connector and a standard USB type-A connector complementary to that with which said first reversible connector functionally mates, said second reversible connector including:

(a) a shielding sleeve defining a direction of mating, and (b) a pair of retractable slides each assuming an initial position and selectively retractable parallel to said direction of mating to a retracted position, said pair of slides assuming:

(i) a neutral configuration, prior to coupling with the standard USB connector, in which both of said slides are in said initial position, (ii) a first displaced configuration, when coupled with the standard USB connector in a first coupling orientation, in which a first of said slides is in said retracted position, and (iii) a second displaced configuration, when coupled with the standard USB connector in a second coupling orientation, in which a second of said slides is in said retracted position.

23. A system comprising a reversible connector for functionally mating with a standard USB type-A connector in each of two coupling orientations, said reversible connector including:

(a) a shielding sleeve defining a direction of mating, and (b) a pair of retractable slides each assuming an initial position and selectively retractable parallel to said direction of mating to a retracted position, said pair of slides assuming:

(i) a neutral configuration, prior to coupling with the standard USB connector, in which both of said slides are in said initial position, (ii) a first displaced configuration, when coupled with the standard USB connector in a first coupling orientation, in which a first of said slides is in said retracted position, and (iii) a second displaced configuration, when coupled with the standard USB connector in a second coupling orientation, in which a second of said slides is in said retracted position, wherein said first slide is biased from said retracted position to said initial position by a first spring having a spring constant K1, and said second slide is biased from said retracted position to said initial position by a second spring having a spring constant K2, K1 being significantly greater than K2.

24. The system of claim 23, wherein said reversible connector is referred to as said first reversible connector, the system further comprising a second reversible connector for functionally mating in each of two coupling orientations with each of said first reversible connector and a standard USB type-A connector complementary to that with which said first reversible connector functionally mates, said second reversible connector including:

(a) a shielding sleeve defining a direction of mating, and (b) a pair of retractable slides each assuming an initial position and selectively retractable parallel to said direction of mating to a retracted position, said pair of slides assuming:

(i) a neutral configuration, prior to coupling with the standard USB connector, in which both of said slides are in said initial position, (ii) a first displaced configuration, when coupled with the standard USB connector in a first coupling orientation, in which a first of said slides is in said retracted position, and (iii) a second displaced configuration, when coupled with the standard USB connector in a second coupling orientation, in which a second of said slides is in said retracted position, wherein said first slide is biased from said retracted position to said initial position by a first spring having a spring constant K3, and said second slide is biased from said retracted position to said initial position by a second spring having a spring constant K4, wherein K3 and K4 have values smaller than K1 and greater than K2.

25. The system of claim 24, wherein K3 is substantially equal to K4.

* * * * *